US008359709B2

(12) United States Patent
Van Gennep

(10) Patent No.: US 8,359,709 B2
(45) Date of Patent: Jan. 29, 2013

(54) LOCKING HINGE ASSEMBLY

(76) Inventor: Jan Van Gennep, Lakeport, CA (US)

( * ) Notice: Subject to any disclaimer, the term of this patent is extended or adjusted under 35 U.S.C. 154(b) by 492 days.

(21) Appl. No.: 12/708,397

(22) Filed: Feb. 18, 2010

(65) Prior Publication Data

US 2010/0218344 A1 Sep. 2, 2010

Related U.S. Application Data

(60) Provisional application No. 61/153,585, filed on Feb. 18, 2009.

(51) Int. Cl.
*E05D 11/10* (2006.01)

(52) U.S. Cl. ..... 16/328; 16/353; 16/262; 16/386; 16/229

(58) Field of Classification Search ..... 16/265, 16/260, 261, 262, 263, 270, 254, 255, 256, 16/257, 258, 259, 319, 321, 328, 329, 331, 16/352, 353, 324, 381, 386, 229, 327
See application file for complete search history.

(56) References Cited

U.S. PATENT DOCUMENTS

| | | | | |
|---|---|---|---|---|
| 2,542,340 | A * | 2/1951 | Mauraton | 16/381 |
| 3,448,486 | A | 6/1969 | Wright | |
| 3,629,900 | A * | 12/1971 | Beerli, Jr. | 16/325 |
| 3,744,085 | A * | 7/1973 | Griego | 16/386 |
| 4,528,718 | A | 7/1985 | Brockhaus | |
| 4,675,940 | A * | 6/1987 | Brockhaus | 16/254 |
| 4,854,009 | A * | 8/1989 | Brockhaus | 16/263 |
| 4,864,688 | A * | 9/1989 | Gerber | 16/261 |
| 4,991,259 | A * | 2/1991 | Finkelstein et al. | 16/312 |
| 5,577,295 | A * | 11/1996 | Papke et al. | 16/386 |
| 5,706,556 | A * | 1/1998 | Kluting | 16/386 |
| 5,820,288 | A | 10/1998 | Cole | |
| 6,922,872 | B2 * | 8/2005 | Gruber | 16/260 |
| 7,325,276 | B2 * | 2/2008 | Kim | 16/262 |
| 7,603,746 | B1 * | 10/2009 | von Resch et al. | 16/260 |
| 8,156,611 | B2 * | 4/2012 | Machin et al. | 16/254 |
| 2004/0025294 | A1 * | 2/2004 | Gruber | 16/254 |
| 2009/0056075 | A1 * | 3/2009 | Green et al. | 16/328 |

FOREIGN PATENT DOCUMENTS

WO WO 9010775 A1 * 9/1990

* cited by examiner

*Primary Examiner* — Jeffrey O Brien

(74) *Attorney, Agent, or Firm* — Craig M. Stainbrook; Stainbrook & Stainbrook, LLP

(57) ABSTRACT

A door hinge assembly with hinge members having axially aligned cylindrical passages with interior surface shape, and a selectively depressible hinge pin with an exterior shape that matches the interior hinge member passages so as to permit selective locking of the hinge members.

5 Claims, 7 Drawing Sheets

LOCKING HINGE ASSEMBLY

CROSS REFERENCES TO RELATED APPLICATIONS

The present application claims the benefit of U.S. Provisional Patent Application Ser. No. 61/153,585 filed Feb. 18, 2009 (Feb. 18, 2009).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

SEQUENCE LISTING

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to hinge assemblies, and more particularly to hinges for closures, such as doors, windows, hatches, lids, ports, and the like, and also for panels or surface members that pivot in relation to another panel or surface member, such as shelves, awnings, ramps, gates, and the like.

2. Discussion of Related Art Including Information Disclosed Under 37 CFR 1.97, 1.98

Locking hinges and hinge assemblies are known. Exemplary publications teaching such technology include:

U.S. Pat. No. 5,820,288 to Cole, which teaches an adjustable tool with a locking hinge mechanism. The tool may be moved between a number of selectable positions through the use of a hinge pin, which is splined along its length and holds the portions of the tool together. The hinge pin is movable between an unlocked position and a locked position. In the unlocked position, the tool is adjustable, and in the locked position the tool is fixed in position and ready for use.

U.S. Pat. No. 4,528,718 to Brockhaus shows a door hinge including a first and a second hinge member each having eyes with a hinge pin inserted through the eyes of the hinge members to connect them operatively together. The hinge pin is mounted so as to be freely rotatable relative to a first eye but secured against axial movement relative thereto. The hinge pin and a second eye are formed with axially extending splines engaged between them, and axially adjacent the splines, the hinge pin is formed with a cylindrical section which engages within a complementary cylindrical recess in the second eye, the cylindrical section having a diameter which is slightly greater than the addendum circle diameter of the splines.

U.S. Pat. No. 3,448,486 to Wright, teaches a locking hinge with a sliding adjustable pintle for locking cabinets, doors, lids, and the like. The pintle is formed with splines and is adjustable to a locked and unlocked position. In the locked position the splines engage hinge knuckles such that the hinge is prevented from turning. In the open position, the splines are disengaged from the knuckles and the hinge is free to turn.

The foregoing prior art reflects the current state of the art of which the present inventor is aware. Reference to, and discussion of, this prior art is intended to aid in discharging Applicant's acknowledged duty of candor in disclosing information that may be relevant to the examination of claims to the present invention. However, it is respectfully submitted that none of the above-indicated publications disclose, teach, suggest, show, or otherwise render obvious, either singly or when considered in combination, the invention described and claimed herein.

BRIEF SUMMARY OF THE INVENTION

The present invention is a novel hinge assembly that includes a first hinge member having a leaf and a lower sleeve. The lower sleeve includes an upper cylindrical passage with a first diameter and a lower cylindrical passage axially disposed immediately under the upper cylindrical passage and having a second diameter smaller than that of the upper cylindrical passage. The lower cylindrical passage has an interior wall with either a geometrical shape or surface topography. A second hinge member includes a leaf portion and an upper sleeve, the upper sleeve including an upper female portion and a lower male element extending axially downwardly from the female portion and has an outer diameter sized to fit tightly into the opening of the upper cylindrical passage of the lower sleeve so as to provide a smooth pivotal connection between the first and second hinge members. The male element further includes a lower portion with an interior wall configured substantially identically to that of the interior wall of the lower cylindrical passage of the lower sleeve. A through hole passes through the upper sleeve elements. When the male element of the upper sleeve is inserted into the lower sleeve, the through hole is axially aligned with the upper cylindrical passage and the lower cylindrical passage of the lower sleeve. A hinge pin is inserted into the upper cylindrical passage of the second hinge member and the lower cylindrical passage of the first hinge member. The hinge pin includes an outer surface configured or contoured in such a way to cooperate with the configuration of the interior wall of the lower sleeve. The hinge pin as an elevated locked position and a depressed unlocked position, such that when in the unlocked position no portion of the hinge pin outer surface engages the interior walls to prevent pivotal rotation of the hinge members in relation to one another, and when pushed into the up and locked position, the outer surface of the hinge pin engages the interior walls to prevent the hinge members from rotating in relation to one another.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE SEVERAL VIEWS OF THE DRAWINGS

The invention will be better understood and its objects and advantages will become apparent when consideration is given to the following detailed description thereof. Such description makes reference to the annexed drawings wherein.

DETAILED DESCRIPTION OF THE INVENTION

Figure 2:
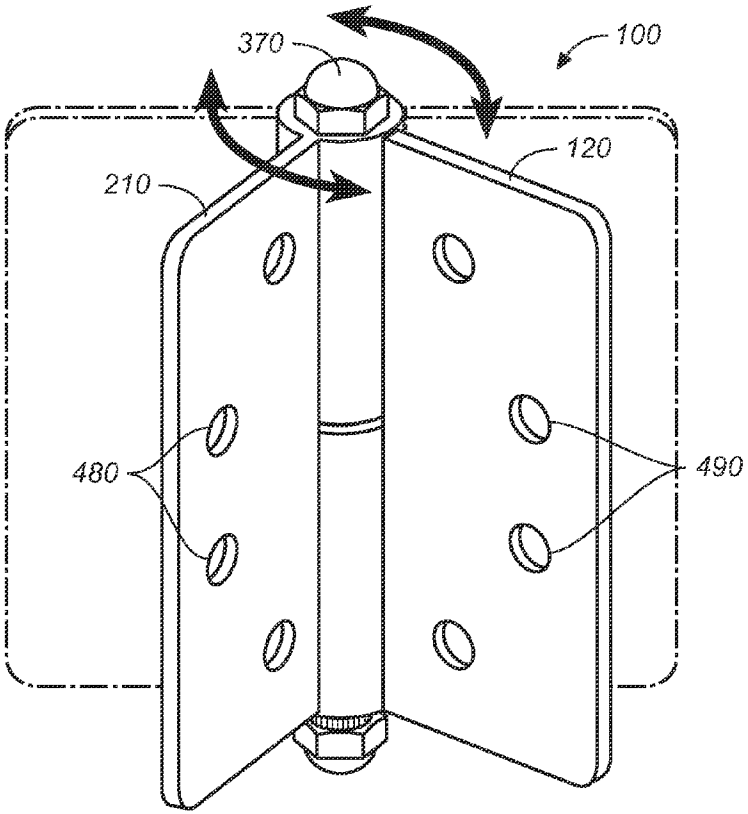
FIG. 2 is an upper front perspective view showing the possible hinge leaves rotation about the hinge pin when in an unlocked position so as to assume a partly closed position.
Figure 1:
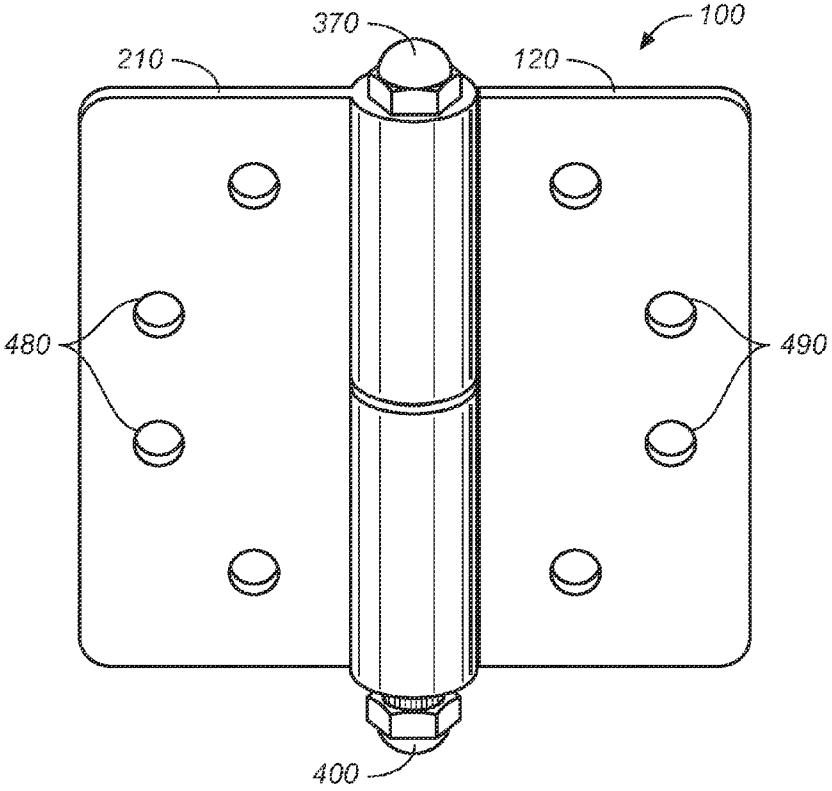
FIG. 1 is an upper front perspective view showing the inventive hinge assembly in a fully open and unlocked position.
Figure 1A:
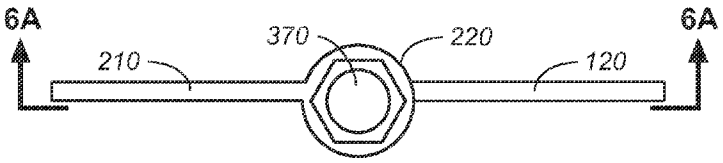
FIG. 1A is a top plan view thereof.
Figure 2A:
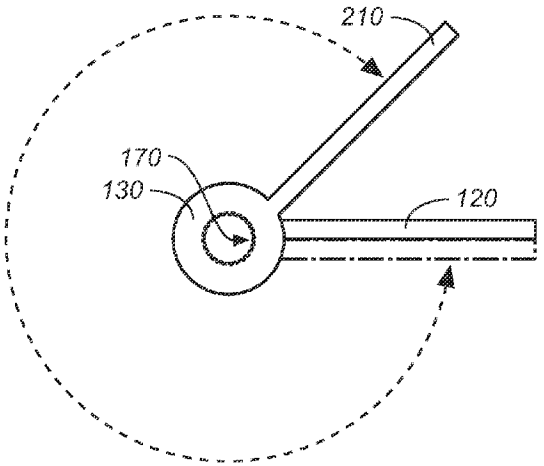
FIG. 2A is a top plan view thereof.
Figure 3:
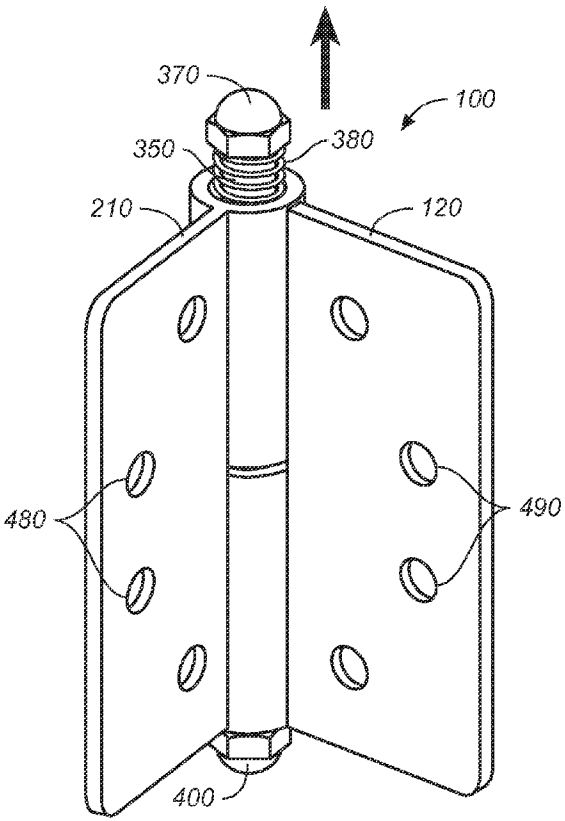
FIG. 3 shows the hinge assembly in a partly closed position and the hinge pin pushed into a locked position to prohibit all hinge leaf rotation.
Figure 4:
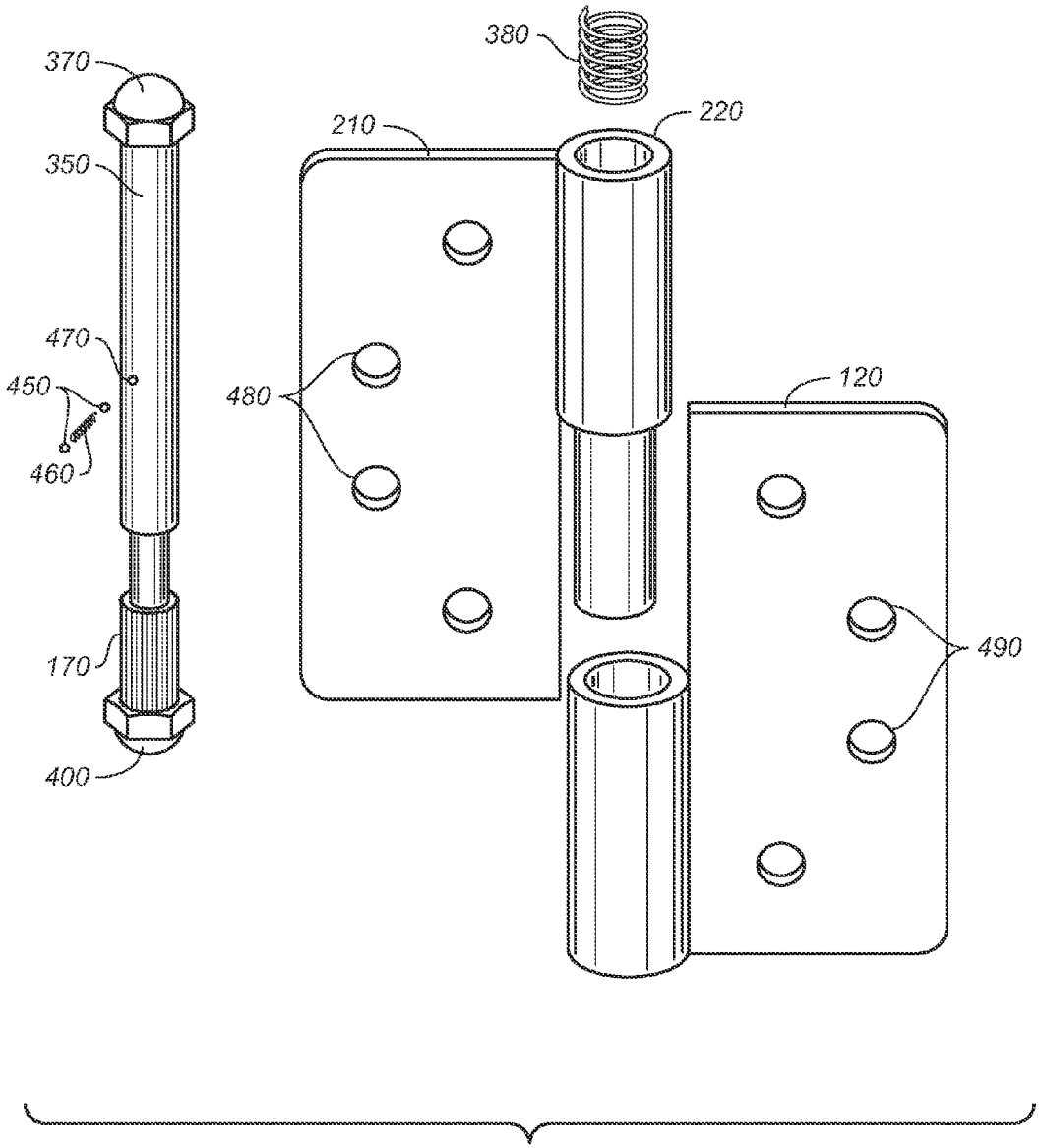
FIG. 4 is an exploded upper front perspective view of the hinge of FIGS. 1-3.
Figure 5:
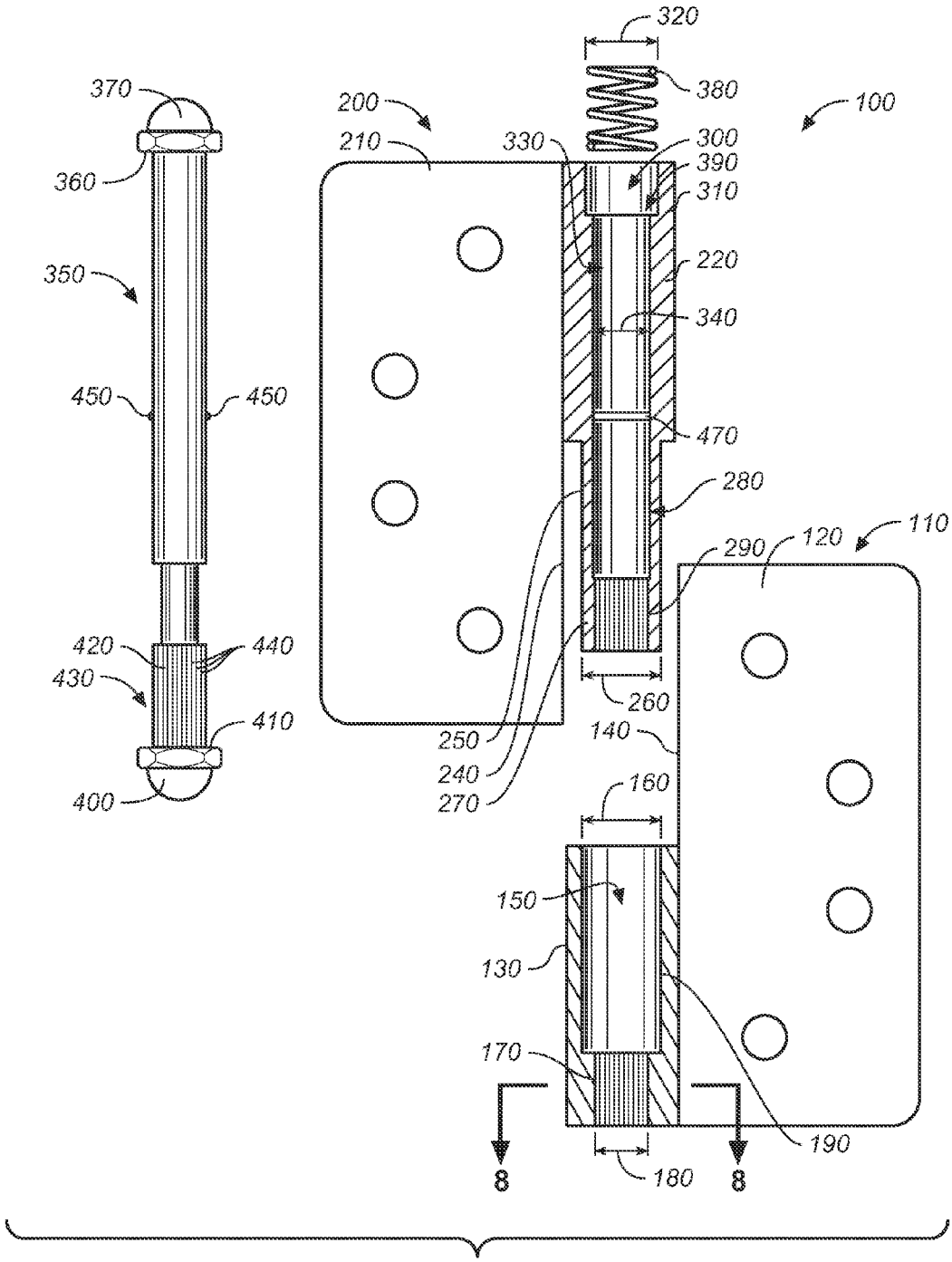
FIG. 5 is an exploded front view in elevation showing the upper and lower hinge sleeves in cross section.
Figure 6B:
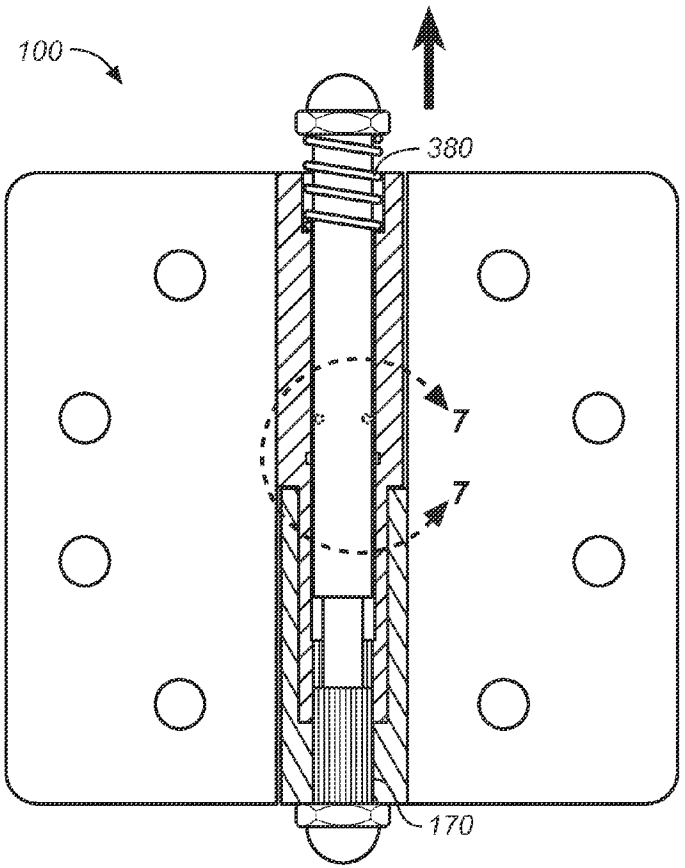
FIG. 6B is a partial cross-sectional front view in elevation showing the hinge in an unlocked position.
Figure 6A:
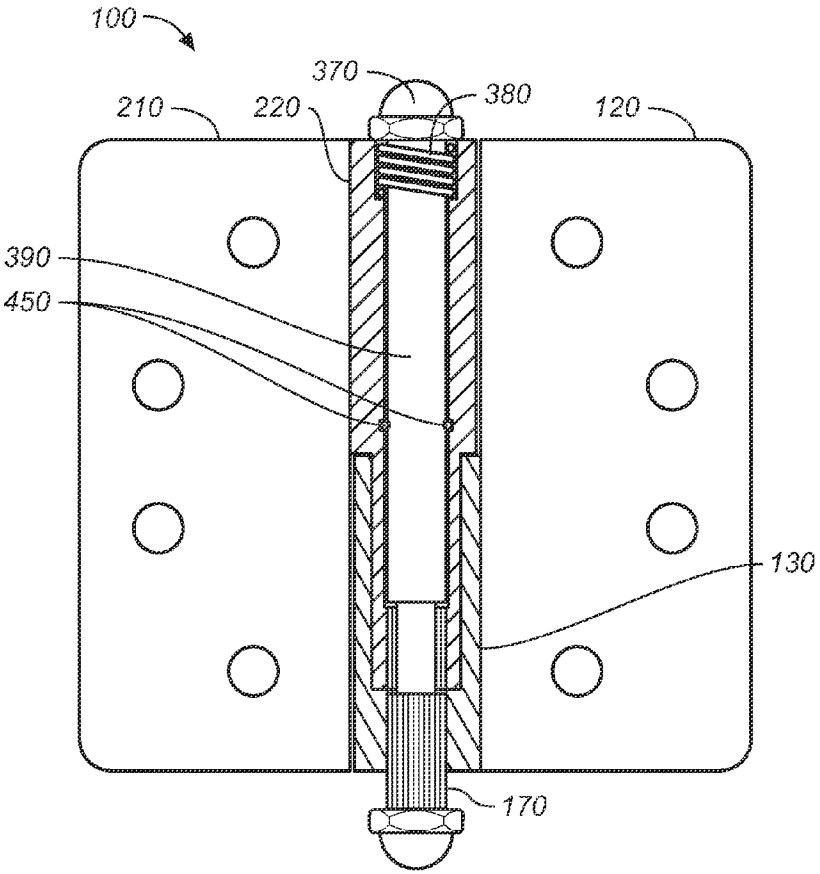
FIG. 6A is a partial cross-sectional front view in elevation taken along section lines 6A-6A showing the hinge in a locked position.
Figure 7:
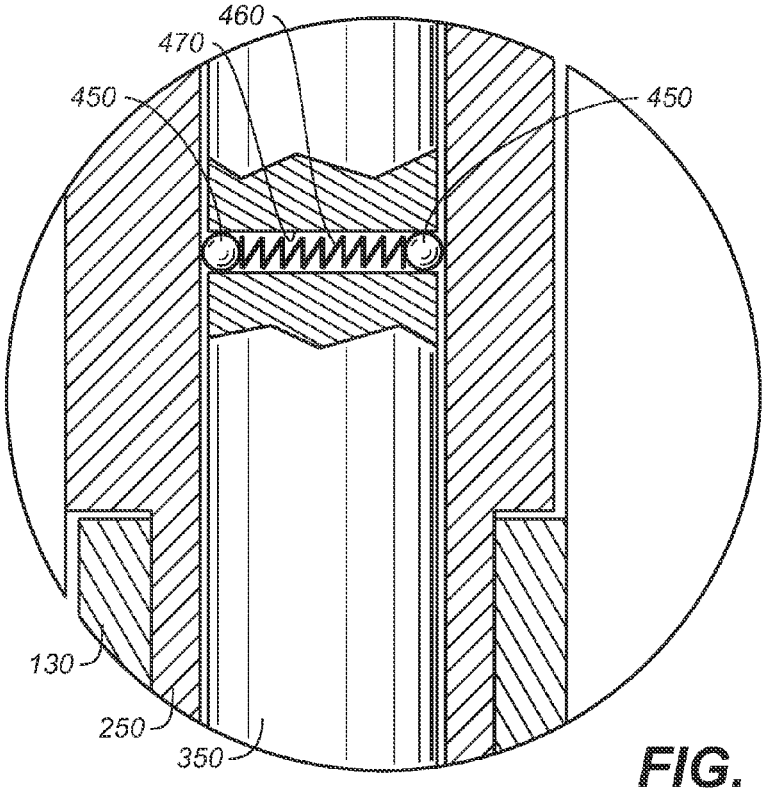
FIG. 7 is a detailed view taken along section line 7-7 of FIG. 6B, showing the spring loaded ball bearing detent used to prevent unwanted migration of the hinge pintle from either the unlocked or locked position.
Figure 8:
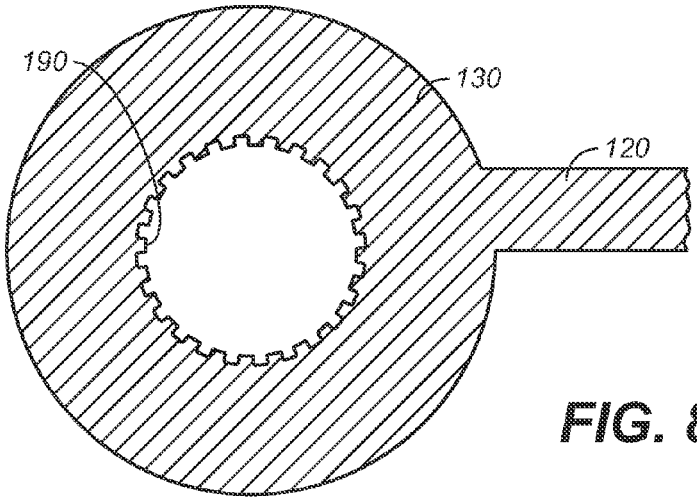
FIG. 8 is an upper cross-sectional view showing the splined interior of the lower hinge leaf taken along section line 8-8 of FIG. 5.
Figure 9A:
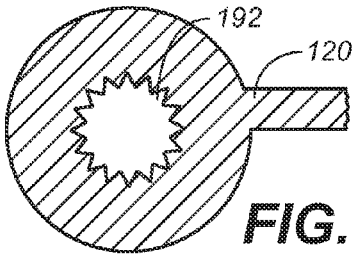
FIG. 9A shows an alternative configuration or shape for the exterior of the locking element of the hinge sleeve.
Figure 9B:
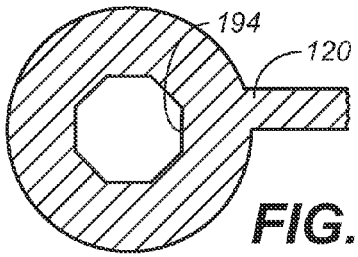
FIG. 9B shows yet another alternative configuration for the locking element of the hinge sleeve.

Referring to FIGS. 1 through 12, wherein like reference numerals refer to like components in the various views, there is illustrated therein a new and improved locking hinge assembly, generally denominated 100 herein. These views collectively show that the inventive hinge assembly includes a first hinge member 110 having a leaf portion 120 and a lower cylindrical sleeve portion (a gudgeon or eye) 130, which is roughly half the height of the leaf portion in dimension and extends along and is integral with the lower half of the interior edge 140 of the leaf portion. The lower sleeve 130 has an upper cylindrical passage 150 with a first diameter 160 and a lower cylindrical passage 170 axially disposed immediately under the upper cylindrical passage 150 and having a second diameter 180 smaller than that of the upper cylindrical passage. The lower cylindrical passage has an interior wall 190 that is splined (FIG. 8) or otherwise provided with a surface topography, e.g., gear teeth 192 (FIG. 9A) or with a cross-sectional shape 194 (FIG. 9B) so as to function as a locking element in cooperation with the hinge pin (described fully below).

The hinge assembly next includes a second hinge member 200 having a leaf portion 210 and an upper sleeve (eye or gudgeon) 220, the upper sleeve including an upper female portion 230 also comprising roughly half the height of the leaf portion and integral with the upper half of the inner edge 240 of the leaf portion. The upper sleeve further includes a lower male element 250 extending axially downwardly from the female portion and having an outer diameter 260 sized for a tight fit insertion into the opening of the upper cylindrical passage 150 of the lower sleeve 130 in a manner well known in the art so as to provide a smooth pivotal connection between the two hinge members. A lower portion 270 of the male element interior wall 280 is splined 290 or otherwise configured or shaped identically to that of the interior wall 190 of the lower cylindrical passage 170 of the lower sleeve 130.

The upper sleeve includes a recess 300 (or countersink) at its upper end 310 and having a first diameter 320 and a cylindrical through hole 330 having a second diameter 340. When the male element of the upper sleeve is inserted into the lower sleeve 130, the through hole 330 is axially aligned with the upper cylindrical passage 150 and the lower cylindrical passage 170 of the lower sleeve 130 so as to accommodate insertion of a hinge pin 350. The hinge pin includes an upper end 360 capped by an upper nut 370 threadably installed on the hinge pin. A helical compression spring 380 is disposed between the underside of the upper nut and the base 390 of the recess 300 in the upper sleeve. A lower nut 400 is threadably installed on the lower end 410 of the hinge pin. The helical compression spring is optional and is needed only when a single leaf hinge is employed, such as in a gate installation. While the spring may be employed to assist in keeping the hinge pin in an elevated (locked) position, the detent mechanism described below is sufficient for most applications.

Next, the outer surface 420 of a lower portion 430 of the hinge pin includes splines, gear teeth, or a shape or geometric cross-sectional configuration 440 that cooperates with the splined interior wall 190 of the lower sleeve 130 to prevent rotation of the hinge pin. It will be seen that when the hinge is pushed down into the unlocked position, no portion of the hinge pin splines engages the splines (or other topography or shape) to prevent pivotal rotation of the hinge.

The hinge pin further includes at least one, and preferably two, detent mechanisms, comprising first and second ball and spring combinations 450, 460, disposed in a through hole 470 drilled through the pin. A single spring may be employed with balls disposed at each end, and the balls are thus biased against the opposing sides of the interior portion of the female portion of the upper sleeve as the hinge pin travels through the upper sleeve. It will be seen that when the hinge pin is pushed down into the unlocked position (FIG. 6A) ball and spring combinations disposed in the through hole of the hinge pin cooperates with female portion of the upper sleeve prevent excursion of the hinge upwardly. When the hinge pin is pushed upwardly and into the locked configuration (FIG. 6B), the helical compression spring 380 (if provided) and the ball and spring combinations 450, 460 work to prevent unwanted drop of the hinge pin back into the unlocked position. When in the locked position, the splines on the hinge pin engage both the interior wall 190 of the lower cylindrical passage 170 of the lower sleeve 130 and the splines of the male element interior wall 290 such that the hinge members are prevented from pivoting relative to one another.

In the illustrated exemplary embodiment, the hinge members are shown as conventional butt/mortise door hinges, each having a plurality of holes 480, 490, for securing the hinge member to a door and/or door frame, though countless other hinge styles and configurations may incorporate the inventive system disclosed herein.

Figure 12:
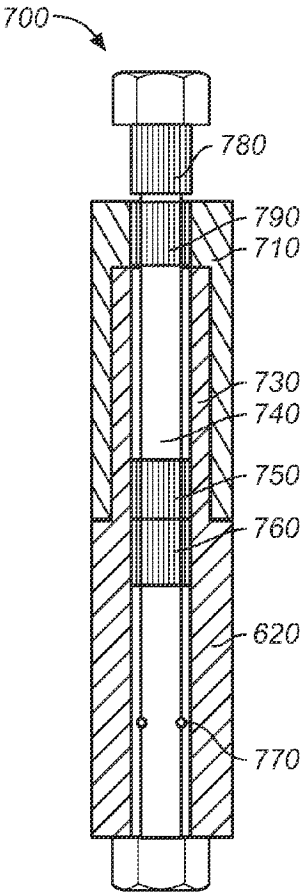
FIG. 12 is a cross-sectional side view in elevation showing the upper and lower sleeve portions and hinge pint of a fourth preferred embodiment.
Figure 11:
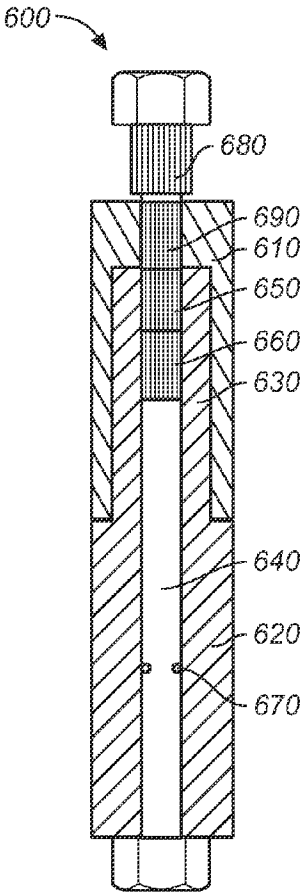
FIG. 11 is a cross-sectional side view in elevation showing the upper and lower sleeve portions and hinge pint of a third preferred embodiment.
Figure 10:
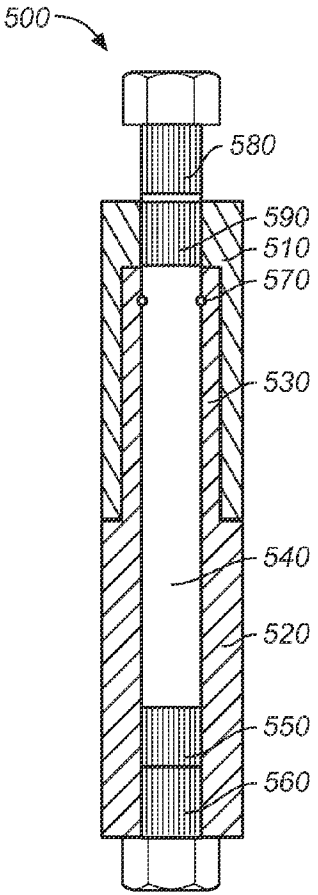
FIG. 10 is a cross-sectional side view in elevation showing the upper and lower sleeve portions and hinge pin of a second preferred embodiment of the inventive locking hinge.

Referring next to FIGS. 10-12, there is shown a second, a third, and a fourth preferred embodiments, respectively, 500,

600, 700, of the novel locking hinge assembly, each providing a slightly different structural relationship of the operative elements of the invention. It will be appreciated that the changes relate principally to the relocation of the cooperative splined elements and the detent mechanism either upwardly or downwardly from the positions shown in the first preferred embodiment. In all other material respects, the inventive apparatus is essentially functionally identical to the above-described first preferred embodiment.

In each of the second, third, and fourth preferred embodiments, the apparatus includes an upper sleeve portion 510, 610, 710, a lower sleeve portion 520, 620, 720, having a male element 530, 630, 730, and a hinge pin 540, 640, 740 with splines 550, 650, 750, disposed around its exterior circumference that engage splines 560, 660, 760 disposed on the interior wall of some portion of the lower sleeve when the pin is in the locked position (shown in all three views). The spring detents 570, 670, 770 prevent the pin from moving from its locked position. When pushed into the unlocked position, splines 580, 680, 780, at one end of the hinge pin engage splines 590, 690, 790 disposed in the upper sleeve portion.

In relation to known conventional door hinges, the most significant distinguishing features of the inventive locking hinge reside in the effect of removing the hinge pin. In the case of the prior art, the hinges essentially separate when the hinge pin is removed, much to the consternation of any handyman who has tried to remove or hang a door. By contrast, the inventive locking hinge includes a male element that slips into a female element so as to prevent such a separation. Indeed, the combined hinge members provide a fully functional hinge even without the hinge pin installed. The hinge pin provides further stability, but its essential function is not to hold the hinge members together, but to provide a rapid locking/unlocking mechanism.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A hinge assembly, comprising:

a first hinge member having a leaf portion and a lower sleeve, said lower sleeve having an upper cylindrical passage with a first diameter and a lower cylindrical passage axially disposed immediately under said upper cylindrical passage and having a second diameter smaller than that of said upper cylindrical passage, said lower cylindrical passage having an interior wall with a surface topography;

a second hinge member having a leaf portion and an upper sleeve, said upper sleeve including an upper female portion and a lower male element extending axially downwardly from said female portion and having an outer diameter sized to fit into the opening of said upper cylindrical passage of said lower sleeve so as to provide a pivotal connection between said first and second hinge members, wherein said male element includes a lower portion having an interior wall configured substantially identically to that of said interior wall of said lower cylindrical passage of said lower sleeve, and wherein said upper sleeve includes a recess at its upper end, having a first diameter, and a cylindrical through hole having a second diameter, such that when said male element of said upper sleeve is inserted into said lower sleeve, said through hole is axially aligned with said upper cylindrical passage and said lower cylindrical passage of said lower sleeve;

a hinge pin inserted into said upper cylindrical passage and said lower cylindrical passage, said hinge pin including an upper end, a lower end, a lower portion having an outer surface including a surface topography that cooperates with the surface topography of said interior wall of said lower sleeve;

wherein when said hinge pin is pushed up into a locked position, said first hinge members are prevented from rotating in relation to one another, and wherein when said hinge pin is pushed down into an unlocked position, no portion of said hinge pin outer surface engages said interior wall of said male element to prevent pivotal rotation of said hinge assembly.

2. The hinge assembly of claim 1, further including a helical compression spring disposed between the underside of an upper nut and a base of the recess in said upper sleeve so as to urge said hinge pin into an elevated, locked position.

3. The hinge assembly of claim 1, further including at least one detent mechanism, comprising ball and spring combinations disposed in a through hole drilled through the pin, wherein when said hinge pin is pushed down into an unlocked position, said ball and spring combination cooperates with said female portion of said upper sleeve to prevent excursion of said hinge pin upwardly, and wherein when said hinge pin is pushed upwardly and out of the unlocked configuration, said ball and spring combination work to prevent unwanted drop of said hinge pin back into an unlocked position.

4. A hinge assembly, comprising:

a first hinge member having a leaf portion and a lower sleeve, said lower sleeve including an upper cylindrical through hole and a lower through hole axially aligned with said upper cylindrical through hole, said upper cylindrical through hole and said lower through hole having a different diameter, and said lower through hole having a configured interior surface;

a second hinge member having a leaf portion and an upper sleeve, said upper sleeve including a male element having a cylindrical outer portion sized to insert into said upper cylindrical through hole of said lower sleeve, and a female portion disposed above said male element, said female portion and said male element having axially aligned through holes that axially align with the upper cylindrical through hole and lower through hole in said lower sleeve when said male element is inserted into said upper cylindrical through hole of said lower sleeve, thereby providing a pivotal connection between said first and second hinge members, wherein the through hole of said lower male element of said upper sleeve includes a lower portion with an interior wall configured substantially identical to that of said interior surface of said lower cylindrical passage of said lower sleeve;

a hinge pin inserted into said upper cylindrical through hole and said lower through hole, and having a lower portion with an outer surface configured to cooperate with said configured interior surface of said lower sleeve, wherein rotation of said first hinge member in relation to said second hinge member is permitted when said hinge pin is moved into an unlocked position such that no portion of said outer surface of said lower portion of said hinge pin engages said configured interior wall of said male element, and wherein rotation is prevented when said hinge pin is moved into a locked position such that at least a portion of said outer surface of said lower portion of said hinge pin engages said configured interior wall of said male element.

5. The hinge assembly of claim 4, wherein rotation of said first hinge member in relation to said second hinge member is permitted when said hinge pin is pushed down into an unlocked position such that no portion of said outer surface of said lower portion of said hinge pin engages said configured interior wall of said male element, and rotation is prevented when said hinge pin is elevated into a locked position such that at least a portion of said outer surface of said lower portion of said hinge pin engages said configured interior wall of said male element.

* * * * *